US012178281B2

(12) United States Patent
Hatano et al.

(10) Patent No.: US 12,178,281 B2
(45) Date of Patent: Dec. 31, 2024

(54) SHOE

(71) Applicant: ASICS CORPORATION, Hyogo (JP)

(72) Inventors: Genki Hatano, Hyogo (JP); Satoru Abe, Hyogo (JP); Shohei Kitao, Hyogo (JP); Yasuyuki Takada, Hyogo (JP); Naoki Sakajo, Hyogo (JP); Yuji Tamakoshi, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 164 days.

(21) Appl. No.: 17/611,175

(22) PCT Filed: May 15, 2020

(86) PCT No.: PCT/JP2020/019483
§ 371 (c)(1),
(2) Date: Nov. 15, 2021

(87) PCT Pub. No.: WO2020/235494
PCT Pub. Date: Nov. 26, 2020

(65) Prior Publication Data

US 2022/0211143 A1 Jul. 7, 2022

(30) Foreign Application Priority Data

May 17, 2019 (JP) ..... 2019-093558

(51) Int. Cl.
*A43B 13/18* (2006.01)
*A43B 5/00* (2022.01)

(52) U.S. Cl.
CPC ..... *A43B 13/181* (2013.01); *A43B 5/00* (2013.01)

(58) Field of Classification Search
CPC ..... A43B 13/141; A43B 13/223; A43B 13/122; A43B 13/181; A43B 23/028; A43B 23/0235; A43B 23/0295
(Continued)

(56) References Cited

U.S. PATENT DOCUMENTS 3,650,051 A * 3/1972 Sass ..... A43B 5/02 36/133
4,616,432 A * 10/1986 Bunch ..... A43C 1/003 36/114
5,024,007 A 6/1991 Dufour
5,983,529 A 11/1999 Serna
6,338,206 B1 1/2002 Kita
(Continued)

FOREIGN PATENT DOCUMENTS

CN 1207275 2/1999
JP S53141149 11/1978
(Continued)

OTHER PUBLICATIONS

"Search Report of Europe Counterpart Application", issued on May 4, 2022, p. 1-p. 11.
(Continued)

*Primary Examiner* — Jameson D Collier
(74) *Attorney, Agent, or Firm* — JCIPRNET

(57) ABSTRACT

A shoe includes an outsole including a ground contact surface to be in contact with the ground, and an upper attached directly or indirectly to the outsole opposite to the ground contact surface. The outsole includes an outsole body, and a roll-up portion extending from an edge of the outsole body toward the upper. The outsole also includes a flexible region in which at least one cut is formed to extend from the outsole body to the roll-up portion.

14 Claims, 5 Drawing Sheets

(58) Field of Classification Search
USPC ..... 36/103, 114, 119.1
See application file for complete search history.

(56) References Cited

U.S. PATENT DOCUMENTS

| | | | | |
|---|---|---|---|---|
| D639,031 | S | 6/2011 | Smith et al. | |
| 2005/0268492 | A1 | 12/2005 | Fuerst | |
| 2008/0078102 | A1 | 4/2008 | Kilgore et al. | |
| 2009/0300945 | A1* | 12/2009 | Droege | A43B 5/025 36/133 |
| 2013/0008053 | A1 | 1/2013 | Nishiwaki et al. | |
| 2014/0157631 | A1* | 6/2014 | Dodd | A43B 13/141 36/43 |
| 2014/0305006 | A1 | 10/2014 | Azoulay | |
| 2014/0317962 | A1* | 10/2014 | Smith | A43B 5/025 36/102 |
| 2015/0313309 | A1 | 11/2015 | Darden et al. | |
| 2016/0242498 | A1 | 8/2016 | Sakamoto et al. | |
| 2017/0280822 | A1 | 10/2017 | Langvin et al. | |
| 2017/0280823 | A1* | 10/2017 | Langvin | A43B 9/02 |
| 2019/0029363 | A1 | 1/2019 | Lucca | |
| 2019/0151745 | A1* | 5/2019 | Nava | A43B 5/18 |

FOREIGN PATENT DOCUMENTS

| | | |
|---|---|---|
| JP | 657175601 | 11/1982 |
| JP | 102295502 | 12/1990 |
| JP | H06141905 | 5/1994 |
| JP | 2001231605 | 8/2001 |
| JP | 2001511376 | 8/2001 |
| JP | 2005160697 | 6/2005 |
| JP | 2006006571 | 1/2006 |
| JP | 2007144211 | 6/2007 |
| JP | 3196278 | 3/2015 |
| JP | 2015536215 | 12/2015 |
| JP | 2016174657 | 10/2016 |
| JP | 2016174665 | 10/2016 |
| WO | 2011129017 | 10/2011 |
| WO | 2015052792 | 4/2015 |

OTHER PUBLICATIONS

"International Preliminary Report on Patentability(Form PCT/IB/373) of PCT/JP2020/019483," issued on Nov. 16, 2021, with English translation thereof, pp. 1-13.
"Office Action of Japan Counterpart Application", issued on Sep. 12, 2023, with English translation thereof, pp. 1-12.
"Office Action of Japan Counterpart Application", issued on Oct. 31, 2023, with English translation thereof, pp. 1-5.
"Office Action of China Counterpart Application", issued on Feb. 24, 2024, with English translation thereof, pp. 1-13.
"Office Action of China Counterpart Application", issued on Oct. 13, 2024, with English translation thereof, p. 1-p. 11.

* cited by examiner

SHOE

CROSS-REFERENCE TO RELATED APPLICATION

This application is a 371 application of the International PCT application serial no. PCT/JP2020/019483, filed on May 15, 2020, which claims the priority benefit of Japan Patent Application No. 2019-093558, filed on May 17, 2019. The entirety of each of the above-mentioned patent applications is hereby incorporated by reference herein and made a part of this specification.

TECHNICAL FIELD

The present invention relates to shoes, and particularly to sports shoes.

BACKGROUND ART

For sports shoes, different functions and properties are required in each sport. Meanwhile, in many sports, shoes have a feature in common of their components, such as the uppers and outsoles, being basically required to have certain rigidity. In skateboarding, for example, the upper and the vicinity thereof of a shoe may be sometimes brought into contact with a skateboard while the player performs some tricks. Accordingly, for skateboard shoes, for example, the rigidity of their components including the uppers and outsoles may be required to be further improved.

PRIOR ART REFERENCE

Patent Literature

Patent Literature 1: U.S. design publication No. 639031

Patent Literature 1 describes a shoe protection used to prevent a shoe upper from wearing out.

SUMMARY OF INVENTION

Technical Problem

The technology described in Patent Literature 1 can improve the rigidity of uppers. However, in skateboarding, the motion of bending a shoe upper may be sometimes required. Accordingly, if the upper has excessively high rigidity and insufficient flexibility, the upper may obstruct the wearer's motions.

A portion required to have flexibility in a shoe is different depending on the required motion of the wearer, which means that a portion required to have flexibility is different for each type of shoes.

The present invention has been made in view of such actual situations, and a purpose thereof is to provide a shoe of which flexibility in an appropriate portion can be improved without losing the rigidity.

Solution to Problem

In response to the above issue, a shoe according to one embodiment of the present invention includes an outsole including a ground contact surface to be in contact with the ground, and an upper attached directly or indirectly to the outsole opposite to the ground contact surface. The outsole includes an outsole body, and a roll-up portion extending from an edge of the outsole body toward the upper. The outsole also includes a flexible region in which at least one cut is formed to extend from the outsole body to the roll-up portion.

Effects of Invention

The present invention can improve flexibility in an appropriate portion without losing rigidity.

DESCRIPTION OF EMBODIMENTS

Figure 1:
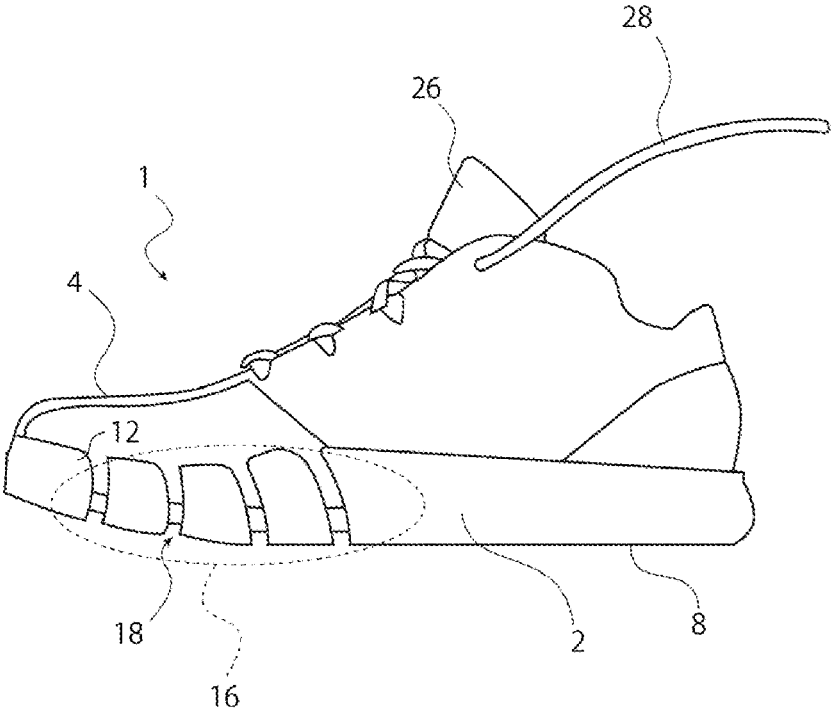
FIG. 1 is a side view of a shoe according to a first embodiment.
Figure 2:
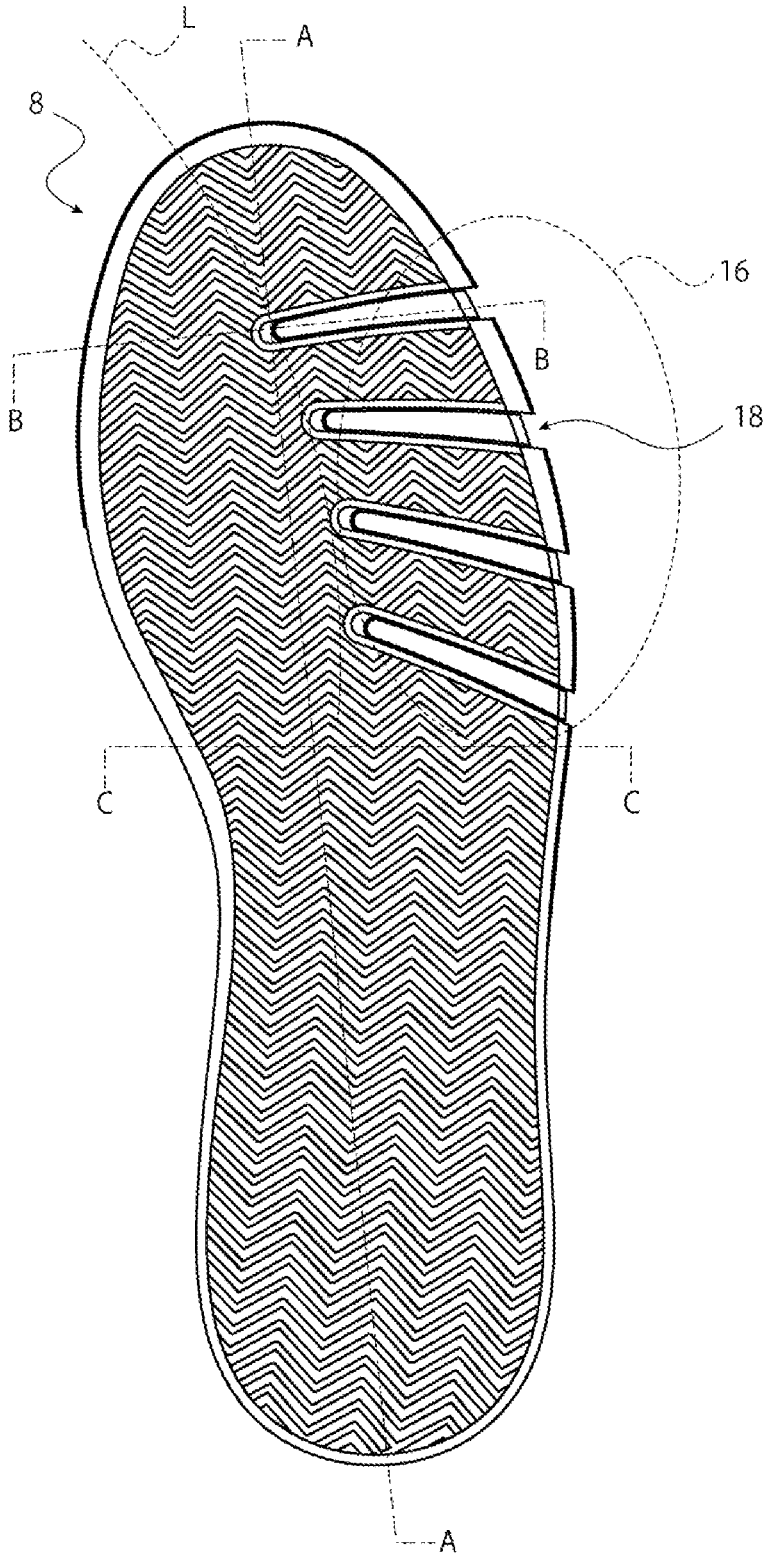
FIG. 2 is a bottom view of the shoe.

In the following, embodiments of the present invention will be described. Like reference characters denote like constituting elements, and repetitive description will be omitted. In each drawing, part of the constituting elements may be appropriately omitted, or the size of a constituting element may be appropriately enlarged or reduced, for the sake of convenience. Also, in each drawing, part of a member less important in describing embodiments may be omitted. Each embodiment will be described in detail, employing a skateboard shoe as an example. The present invention is also applicable to shoes for various kinds of sports other than skateboarding, such as walking, tennis, basketball, soccer, volleyball, wrestling, bicycle riding, and skiing.

In the following embodiments, terms indicating vertical and longitudinal directions will be used, in which the vertical directions mean the upward direction and downward direction (toward the ground contact surface) in the state where a shoe is placed on the ground. Also, the front means the toe side, and the rear means the heel side.

The first embodiment will be described with reference to FIGS. 1 through 5. As illustrated in FIGS. 1 through 5, a shoe 1 includes an outsole 2 that mainly constitutes a bottom part of the shoe 1, an upper 4 that covers an instep, and a midsole 6 placed over an upper surface of the outsole 2.

The outsole 2 may be formed by shaping rubber into a predetermined shape, for example. Although the present embodiment describes an example using a so-called cup sole as the outsole 2, the present invention is also applicable to a so-called vulcanized sole. The outsole 2 has a ground contact surface 8 to be in contact with the ground. The ground contact surface 8 has a certain rugged pattern formed thereon, which improves grip on the ground.

The midsole 6 absorbs impact and is formed of a material for absorbing impact, such as expanded EVA, urethane foam, GEL, and cork. The thickness of the midsole 6 may be appropriately determined depending on the use of the shoe 1. For example, for a shoe used for basketball or the like in which the players often jump, the midsole 6 may preferably be made thicker. The midsole 6 is not an essential configuration and need not necessarily be provided.

Figure 3:
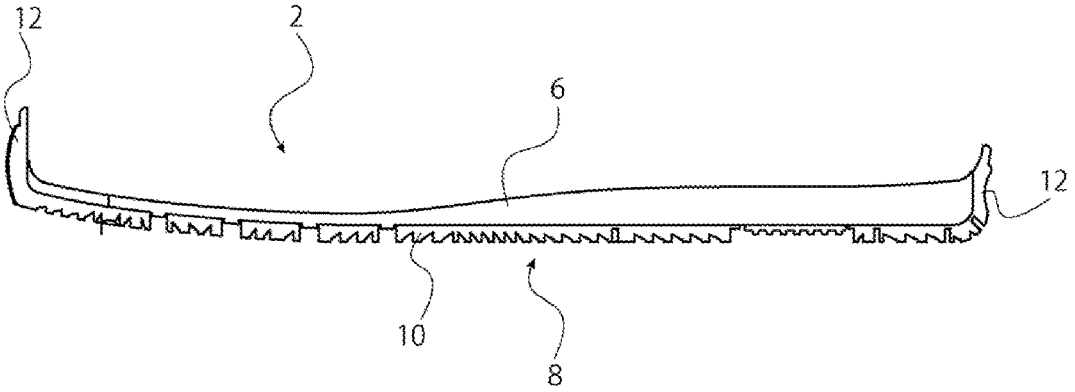
FIG. 3 is a sectional view taken along line A-A in FIG. 2.
Figure 4:
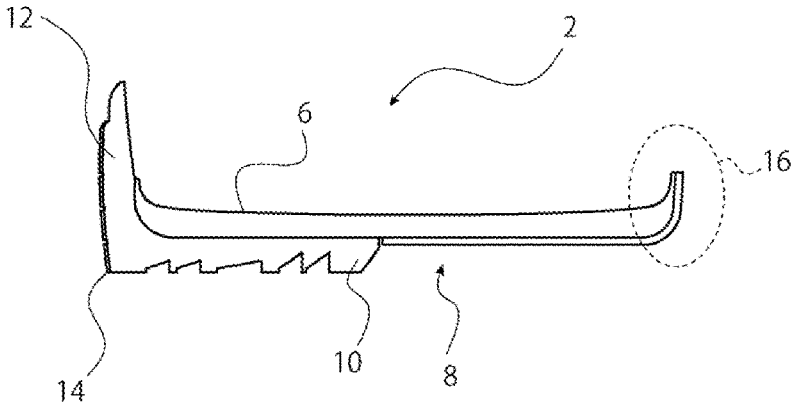
FIG. 4 is a sectional view taken along line B-B in FIG. 2.
Figure 5:
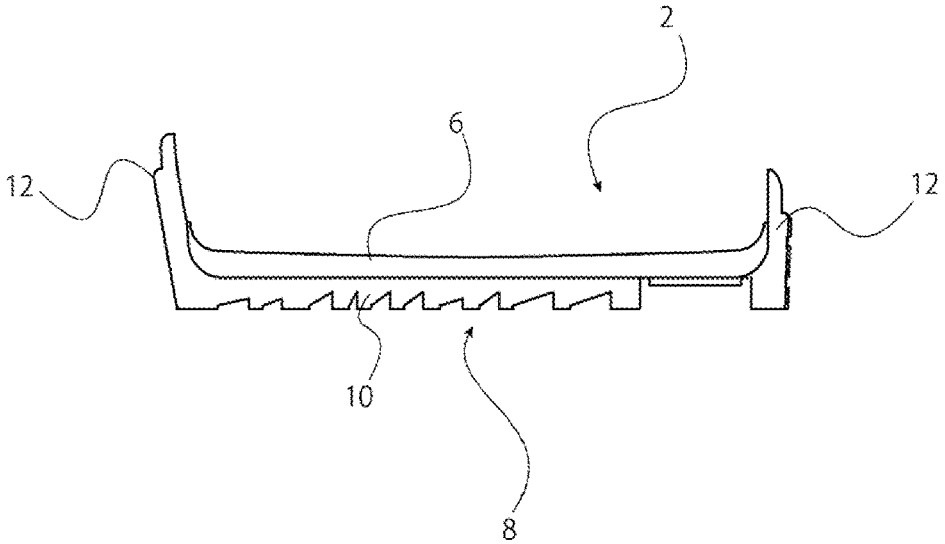
FIG. 5 is a sectional view taken along line C-C in FIG. 2.

As illustrated in FIGS. 3 through 5, the outsole 2 includes an outsole body 10 constituted by a foot-shaped sheet member that is almost flat, and a roll-up portion 12 extending from an edge of the outsole body 10 toward the upper. The bottom surface of the outsole body 10 constitutes the ground contact surface 8, and, on the upper surface of the outsole body 10, the midsole 6 is disposed. The shape of the outsole body 10 need not necessarily be a flat sheet having a uniform thickness. On the upper surface of the outsole body 10, a concave, a convex, or an incline may be formed to match the sole in shape. On the upper surface of the outsole 2, the midsole 6 is disposed. The outsole body 10 and the roll-up portion 12 may be formed of a material such as foamed or non-foamed rubber, or urethane resin. Also, although it is preferable that the outsole body 10 and the roll-up portion 12 are integrally formed, these may be formed by combining members that have been separately formed.

The roll-up portion 12 is formed by a circumferential wall extending upward from the edge of the outsole body 10. More specifically, the roll-up portion 12 extends upward from the position of the upper surface of the outsole body 10 or the bottom surface of the midsole 6. The roll-up portion 12 enhances the rigidity of the shoe 1. The rigidity of the shoe 1 means the flexural rigidity or torsional rigidity, for example. With the enhanced rigidity, a shoe provided with the roll-up portion 12 can improve at least one of the durability including wear resistance and the stability of the shoe while the wearer moves. The position of the upper end of the roll-up portion 12 may be appropriately changed depending on the type of the sport for which the shoe 1 is used. For example, in the case of a skateboard shoe as employed in the embodiment, since higher stability is required, it is preferable that the position of the upper end of the roll-up portion 12 is set to be at least higher than the upper surface of the midsole 6 such as to cover part of the upper 4. The roll-up portion 12 extends along the entire circumferential length of the outsole body 10. Accordingly, the outsole 2 has a cup shape forming a foot shape.

The height of the roll-up portion 12 may be uniform or may be different depending on the position. For example, when rigidity is required on the toe side, the roll-up portion 12 may be made lower on the heel side and higher on the toe side. Also, the height of the roll-up portion 12 may be made different between the medial side and the lateral side in a width direction.

In the case of a skateboard shoe as employed in the present embodiment, it is preferable that an intersection part between the roll-up portion 12 and the ground contact surface 8 (i.e., an angle 14) makes a substantially right angle. With such a structure, the shoe can be made suitable for a sport in which the intersection part with the roll-up portion 12 is used to control a board. Meanwhile, in a shoe used for other sports, the angle 14 need not necessarily be a right angle. For example, the roll-up portion 12 may have a flare shape that is wider toward the ground contact surface 8, and the angle 14 may be an acute angle, or a curved plane may be connected at the intersection part.

The roll-up portion 12 also includes a flexible region 16 for improving the flexibility of the shoe 1. The flexible region 16 is a region provided to improve the flexibility of the entire shoe 1, particularly the flexibility of the outsole 2. In a skateboard shoe according to the embodiment, the flexible region 16 is provided on the lateral side of a forefoot portion (a portion on the toe side and also on the lateral side in a width direction). The forefoot portion as used herein means, when the entire length of the shoe is regarded as 100%, a range of 50% from the toe. The position of the flexible region may be appropriately changed depending on the type of the sport for which the shoe is used. For example, when flexibility is required on the medial side of the forefoot portion (a portion on the toe side and also on the medial side in a width direction) of the shoe, the flexible region may be provided only on the medial side of the forefoot portion. Also, when flexibility is required over the entire forefoot portion, the flexible region may be provided on each of the lateral side and the medial side of the forefoot portion.

The flexible region 16 is configured such that at least one cut 18 is formed on the roll-up portion 12. The cut 18 has a certain width in a longitudinal direction and extends to traverse the roll-up portion 12 in a vertical direction. The number of cuts 18 has only to be at least one and may be appropriately changed depending on the required flexibility. In the present embodiment, four cuts are provided. For example, when higher flexibility is required, the number of cuts 18 may be increased; when lower flexibility is required, on the other hand, the number of cuts 18 may be reduced.

The width in a longitudinal direction of a cut 18 may be changed depending on the use of the shoe and may preferably be in the range of 1 to 8 mm, for example. Also, the width in a longitudinal direction of a cut 18 may be determined based on the width of a portion of the outsole body 10 positioned longitudinally adjacent to a cut 18. In this case, the width of a cut 18 may suitably be one-fifth to one half of the width of the adjacent portion of the outsole body 10. In the present embodiment, the width in a longitudinal direction of a cut is set to about 5 mm. When multiple cuts 18 are formed, the widths of all the cuts 18 may be the same, or the widths of the cuts 18 may be different depending on the position in a longitudinal direction. Also, the width of each cut 18 may be changed depending on the position in an extending direction.

Each cut 18 extends from the upper end of the roll-up portion 12 to around the middle in a width direction of the ground contact surface 8. The length of each cut 18 may be appropriately changed depending on the type of the sport for which the shoe is used. For the shoe 1 for which higher flexibility is required, such as a skateboard shoe, it is preferable that each cut 18 extends from the upper end of the roll-up portion 12 to around the middle in a width direction of the ground contact surface 8. When lower flexibility is required, on the other hand, the length of each cut may be set to a length extending from the upper end of the roll-up portion to the ground contact surface.

With such a cut 18 extending from the upper end of the roll-up portion 12 to around the middle in a width direction of the ground contact surface 8 as illustrated, the midsole 6 is exposed through the cut 18. In other words, with such a structure, the strength of the side surfaces of the outsole 2 and the midsole 6 can be improved, so that the flexibility can be further improved.

Also, each cut 18 may be terminated at a lower end of the roll-up portion 12 or in the middle in a height direction of the roll-up portion 12. When each cut 18 is terminated in the middle in a height direction of the roll-up portion 12, the position in a height direction of the flexible region 16 can be adjusted. In this case, it is preferable that the terminated end of the roll-up portion 12 is positioned at least lower than the bottom surface of the midsole 6 or the upper surface of the outsole 2.

The position of each cut 18 may be appropriately changed depending on the required flexibility. However, when a cut 18 extends onto the ground contact surface 8, it is preferable to determine the position of the cut 18 based on the positions of the metatarsal phalangeal (MP) joints. The positions of the MP joints correspond to positions within the range of 25% to 45% from the front end of the shoe 1. When a cut 18 is formed to extend onto the ground contact surface 8 at a position corresponding to an MP joint, the ground contact surface 8 can be deformed along the MP joint when toes are bent, so that high flexibility can be achieved.

Also, when multiple cuts 18 extending onto the ground contact surface 8 are provided (in the example of FIG. 2), the ends of the cuts 18 on the ground contact surface 8 are arranged along a curve L around the middle in a width direction. The curve L has a shape that bulges toward the lateral side in a width direction of the shoe. Such arrangement of the ends of the cuts 18 can provide the shoe 1 with flexibility appropriate for tread pressure balance on the sole. The virtual line defining the positions of the ends of the cuts 18 is not limited to the curve L. Depending on the use of the shoe, a straight line or a zigzag line may be employed therefor.

Figure 6:
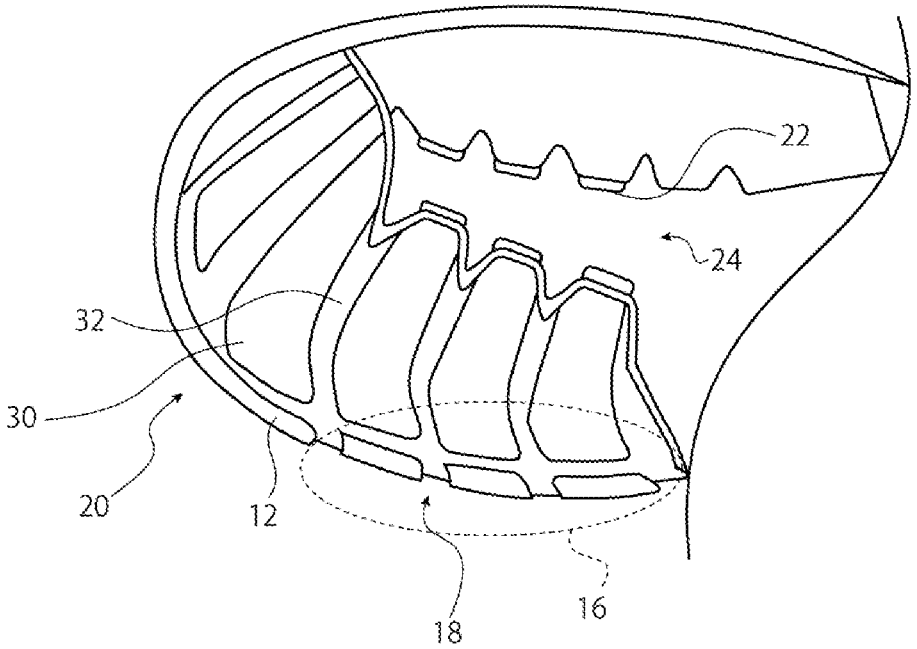
FIG. 6 is a top view of an essential part of the shoe.

As illustrated in FIG. 6, the upper 4 includes an upper protection layer 20, a tightening means (tightening structure) for the upper 4, and a slit 24 that extends in a longitudinal direction of the upper 4 around the middle in a width direction of the upper 4. Also, to the upper 4, a shoe tongue 26 is attached. In the present embodiment, as the tightening means, a structure constituted by a combination of eyelets 22 and a shoelace 28 is employed. As the tightening means, a hook-and-loop fastener or the like may also be used.

The upper 4 may be made of a mesh material obtained by knitting synthetic fiber, such as polyester and polyurethane, or made of synthetic leather or natural leather, for example, and has a shape covering an instep. The slit 24 is a buffer portion provided to adjust the width of the upper 4 by adjusting the degree of tightening the shoelace 28. On each side in a width direction of the slit 24, multiple eyelets 22 are provided. The shoe tongue 26 is exposed through the slit 24, and, when the shoelace 28 is tied, the shoelace 28 has no contact with the wearer's instep.

The upper protection layer 20 may be formed of urethane resin to protect the upper 4 formed of cloth, for example. It is preferable to provide the upper protection layer 20 in a shoe used for a sport in which the upper comes into contact with a board, such as skateboarding, or a sport in which the upper 4 comes into contact with a ball, such as soccer or futsal. Meanwhile, the upper protection layer need not necessarily be provided in a shoe used for a sport in which the shoe is supposed to have no contact with other sporting goods.

The upper protection layer 20 may be formed by applying coating on the base material of the upper 4, instead of pasting urethane resin integrally formed as described above over the upper 4. Also, when the upper 4 is formed, a portion corresponding to the upper protection layer 20 may be knitted from or woven with yarn thicker than that used for other portions so that the base material of the upper 4 itself can be made thicker. Also, when the upper 4 is formed, a portion corresponding to the upper protection layer 20 may be knitted (woven) more densely than other portions.

The slit 24 may be provided to extend in a longitudinal direction of the upper 4 in the middle in a width direction. However, in the present embodiment, the slit 24 has a curved shape extending away from the flexible region 16 in a width direction toward the front side and is formed closer the medial side in a width direction of the shoe 1 with respect to the middle in a width direction of the shoe 1. Accordingly, in the present embodiment, a portion of the upper 4 on the lateral side in a width direction of the slit 24 is wider, and a portion of the upper 4 on the medial side in a width direction of the slit 24 is narrower. On the wider portion side of the upper 4, the upper protection layer 20 is provided. Accordingly, when the front half of the shoe is viewed from the top, the region where the upper protection layer 20 is provided (i.e., the region on the lateral side in a width direction with respect to the slit) is larger than the region where the upper protection layer 20 is not provided and the upper 4 is exposed (i.e., the region on the medial side in a width direction with respect to the slit).

Although the position of the upper protection layer 20 may be changed depending on the use of the shoe 1, it is preferable to determine the position of the upper protection layer 20 based on the position of the flexible region 16. More specifically, the upper protection layer 20 is formed on the flexible region 16 side, with respect to the middle in a width direction of the shoe 1. When the upper 4 is designed, the side (the medial side or the lateral side in a width direction) on which the flexible region 16 is provided is determined first, the upper protection layer 20 is disposed on the flexible region 16 side, and, lastly, the shape of the slit 24 is determined such that the slit 24 extends away from the flexible region 16. Since the upper protection layer 20 is formed of a material harder than the other portions of the upper, if the entire upper 4 is covered with the upper protection layer 20, the upper 4 will become too hard. However, disposing the upper protection layer 20 only on the side where protection is required, i.e., on the flexible region 16 side, can prevent the entire upper 4 from becoming too hard and can also make larger the area of a region where the upper 4 is protected.

It is preferable that the upper protection layer 20 has a width that extends from the upper end of the roll-up portion 12 to the slit 24 in a width direction of the shoe 1. One end in a width direction of the upper protection layer 20 may be in contact with the roll-up portion 12, or a space may be provided between the one end and the roll-up portion 12. Meanwhile, the other end in a width direction of the upper protection layer 20 extends to around the slit 24 and, preferably, covers the eyelets 22 aligned on the lateral side of a width direction to protect the eyelets 22.

The shape and position of the upper protection layer 20 may be appropriately changed depending on the use of the shoe.

The upper protection layer 20 includes a protection reinforcement part 30, which is thick, and a flexibility providing part 32, which is thinner than the protection reinforcement part 30. The flexibility providing part 32 is designed based on an idea similar to that of the cut 18 and formed in a curved shape or a linear shape extending in a width direction along an MP joint. More preferably, a flexibility providing part 32 may be formed along an extended line of a cut 18 such as to form, together with the cut 18, a line. In this case, the cut 18 and the flexibility providing part 32 need not necessarily be continuous. When the upper protection layer 20 and the upper end of the roll-up portion 12 are spaced away from each other, there may be a space between the cut 18 and the flexibility providing part 32. With such a cut 18 and a flexibility providing part 32 provided to form a line, smooth inflection can be promoted.

Each of the protection reinforcement parts 30 and the flexibility providing parts 32 need not necessarily have a constant thickness over the entire upper protection layer 20. The thickness of each of the protection reinforcement parts 30 and the flexibility providing parts 32 may be adjusted depending on the position. Also, an undulate shape may be formed such that the thickness of a protection reinforcement part 30 is tapered to shift to a flexibility providing part 32.

Although the shoe 1 according to the present embodiment employs a structure including the slit 24, the present invention is also applicable to a monosock shoe having no slit. In a monosock shoe, a curved shape may be assumed such as to extend away from the flexible region 16 in a width direction toward the front side, and the upper protection layer 20 may be provided on one side in a width direction with respect to the assumed line.

The shoe tongue 26 extends from the front end of the slit 24 toward the rear side and further extends rearward beyond at least the uppermost eyelet 22 (the rearmost eyelet 22) among multiple rows of eyelets 22. More preferably, the shoe tongue 26 may be configured such that the rear end thereof can be folded back toward the front side, and the shoe tongue 26 may have a length such that the rear end thereof can reach, when the shoe tongue 26 is folded back, a position forward of the uppermost eyelet 22. By setting the length of the shoe tongue 26 in this way, the knot in the shoelace 28 can be covered with the shoe tongue 26, so that the shoelace 28 can be protected by the shoe tongue 26. However, the shoe tongue 26 is not an essential configuration, and the present invention is also applicable to a shoe that does not include the shoe tongue 26. Also, instead of the shoe tongue 26 of which the front end is fixed to the front end of the slit 24 and which extends rearward, a so-called split tongue may be adopted in which the ends in a width direction thereof are fixed respectively to the left and right ends of the slit 24, and a middle portion of the shoe tongue is split into left and right parts.

There will now be described a second embodiment. In the following description, configurations similar to those in the first embodiment will be denoted by the same reference characters as used in the first embodiment, and detailed description thereof will be omitted.

Figure 7:
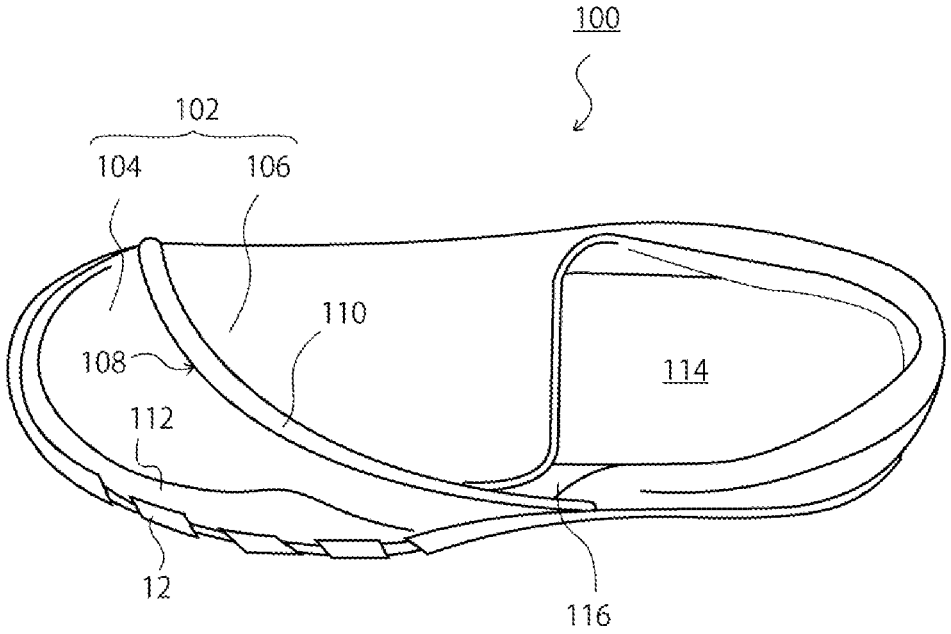
FIG. 7 is a top view of a shoe according to a second embodiment.
Figure 8:
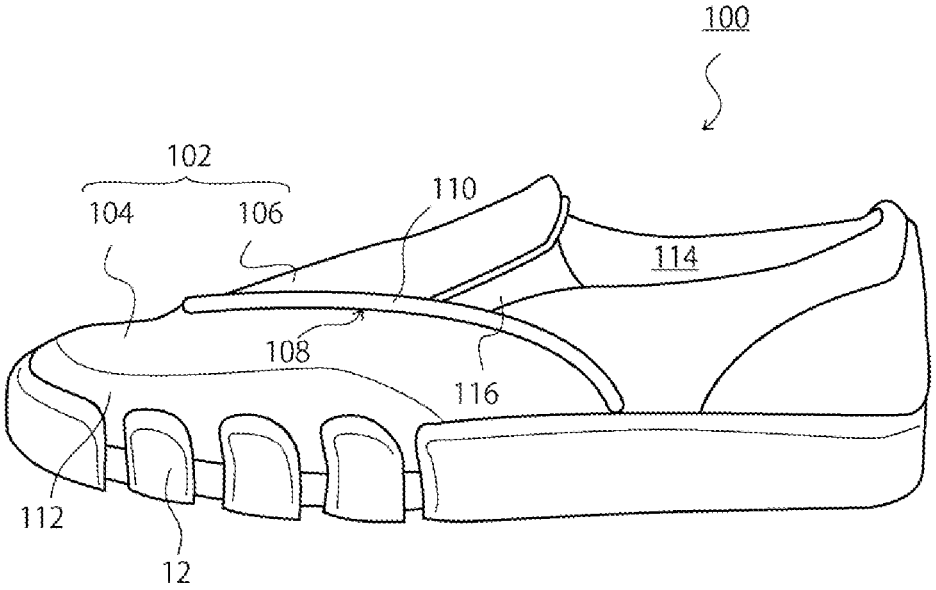
FIG. 8 is a side view of the shoe.

FIG. 7 is a top view of a shoe according to the second embodiment, and FIG. 8 is a side view of the shoe. As illustrated in FIGS. 7 and 8, a shoe 100 is a so-called slip-on shoe that does not include the tightening means.

The shoe 100 includes an upper 102 that covers an instep. The upper 102 covers an instep in the forefoot portion and a midfoot portion from the medial side to the lateral side.

The upper 102 may be formed of a single seamless material or may be formed by patching multiple materials together to achieve a stereoscopic shape more easily.

In the illustrated example, the upper 102 is formed by patching two materials together. The upper 102 as illustrated includes a front upper 104 that mainly covers a lateral portion of a foot, and a rear upper 106 that mainly covers a medial portion of a foot. The front upper 104 and the rear upper 106 are continuous and joined to each other by means of sewing or the like. A front end of the front upper 104 is curved along the front end of the shoe 100. A rear end 108 of the front upper 104 is slanted with respect to a longitudinal direction and a width direction such as to extend rearward toward the lateral side of the foot. The medial side of the rear end 108 of the front upper 104 is positioned in a portion that covers the hallux, and the lateral side thereof is positioned in the rear of a portion that covers the little toe. A front end of the rear upper 106 extends along the rear end 108 of the front upper 104.

Between the front upper 104 and the rear upper 106, a joint part 110 is formed. The joint part 110 is joined along the rear end 108 of the front upper 104. As with the rear end 108, the joint part 110 is slanted with respect to a longitudinal direction and a width direction such as to extend rearward toward the lateral side of the foot. The joint part 110 may be formed by sewing the front upper 104 and the rear upper 106 together. The sewn part may be covered with another material for reinforcement. The joint part 110 is provided at a position in the upper 102 where, during skateboarding, the skateboard comes into contact less frequently. This can reduce the possibility of a skateboard coming into contact with and damaging the joint part 110.

When the upper 102 is constituted by two or more components, it is suitable to provide each joint part between components at a position less likely to be in contact with a skateboard. The position less likely to be in contact with a skateboard means that at least the front end side of a joint part is positioned on the medial side of the foot. Meanwhile, when the upper 102 is formed of a single material, exposure of an edge of the material onto a surface can be prevented, reducing the possibility of a skateboard coming into contact with an edge of the material and damaging the material.

Also, the front upper 104 includes a reinforcement part 112 extending along the front end. The reinforcement part 112 continuously extends from the portion that covers the hallux to a position in the rear of the portion that covers the little toe on the lateral side. The reinforcement part 112 also extends to a position higher than the upper end of the roll-up portion 12. The reinforcement part 112 is formed of a material having higher wear resistance and durability than the material of the front upper 104. The reinforcement part 112 may be formed of a material of which the surface is coated with rubber or urethane, for example, and has only to have high wear resistance at least on the surface. It is preferable that the wear resistance of the shoe 100 becomes higher from the upper side toward the lower side. Although it is preferable to provide the reinforcement part 112 continuously from the portion that covers the hallux to a position in the rear of the portion that covers the little toe on the lateral side, the reinforcement part 112 may be partially cut away.

Also, the rear upper 106 includes a band part 116 made of a stretch material to change the size of an opening 114 into which a foot is inserted. The band part 116 defines part of the opening 114. When a wearer inserts a foot into the opening 114, the band part 116 is stretched by force applied from the foot to the rear upper 106, so as to broaden the opening 114. When the foot is appropriately placed within the shoe 100, the band part 116 shrinks, and the rear upper 106 is appropriately brought in close contact with the instep. Although the band part 116 in this example is provided such as to constitute part of the lateral side of the opening 114, the position of the band part 116 is not limited thereto. With the band part 116 provided, the ease of slipping on and off can be improved.

In addition to the abovementioned embodiments, the following modification may also be considered. A shoe according to the modification includes an outsole of sheet shape that does not include the roll-up portion, and a midsole and an upper provided on the upper surface of the outsole. The midsole includes a midsole roll-up portion that extends upward from a circumferential edge thereof toward the upper, and a midsole cut formed on the midsole roll-up portion. On the outsole, an outsole cut is provided at a position corresponding to a midsole cut.

The configurations of the shoe according to the modification are basically the same as those of the shoes described in the embodiments. When the modification and the embodiments are compared, the roll-up portion is formed on the outsole in the embodiments, whereas, in the modification, the midsole roll-up portion corresponding to the roll-up portion is provided on the midsole. Also, a cut is formed only on the outsole in the embodiments, whereas, in the modification, a midsole cut is formed on the midsole, and an outsole cut is formed on the outsole. It is preferable that a midsole cut and an outsole cut are formed continuously, and such continuous cuts have a configuration similar to that of a cut 18 according to the embodiments.

The midsole roll-up portion is provided by forming only part of the midsole from a high rigidity material, and the midsole roll-up portion has a shape extending toward the upper. The position of a midsole cut (i.e., position of the flexible region in the modification) may be appropriately changed depending on the use of the shoe.

Also, by combining the embodiments and the modification, the flexible region formed in the midsole roll-up portion and the flexible region formed in the outsole roll-up portion may be provided at different positions in a shoe.

Also, an impact buffer structure, such as a GEL material, may be provided inside the midsole or outsole.

Exemplary embodiments of the present invention have been described in detail. Each of the abovementioned embodiments merely describes a specific example for carrying out the present invention. The embodiments are not intended to limit the technical scope of the present invention, and various design modifications, including changes, addition, and deletion of constituting elements, may be made to the embodiments without departing from the scope of ideas of the invention defined in the claims. Also, if a number or an amount is mentioned in the aforementioned embodiments, the scope of the present invention will not necessarily be limited to the number or amount, unless otherwise specified. Further, each constituting element in the embodiments is not necessarily essential to the present invention, unless otherwise specified. Therefore, such changes and modifications are considered to fall within the scope of the present invention as defined by the claims.

When the inventions embodied by the embodiments set forth above are generalized, the following technical ideas are derived.

In the following, description will be made using the first aspect described in TECHNICAL PROBLEM.

A shoe according to the first aspect includes an outsole including a ground contact surface to be in contact with the ground, and an upper attached directly or indirectly to the outsole opposite to the ground contact surface. The outsole includes an outsole body, and a roll-up portion extending from an edge of the outsole body toward the upper. The outsole also includes a flexible region in which at least one cut is formed to extend from the outsole body to the roll-up portion.

According to the first aspect, with the outsole body, the rigidity of the shoe will not be lost, and, with the flexible region, the flexibility of the shoe can be improved.

In a second aspect, the cut in the first aspect has a predetermined width in a longitudinal direction.

With such a configuration, the flexibility can be improved.

In a third aspect, the shoe in the first or second aspect further includes a midsole provided between the outsole and the upper, and the roll-up portion extends to a position higher than an upper surface of the midsole.

With such a configuration, the strength of the side surfaces of the shoe can be improved.

In a fourth aspect, the cut in any one of the first through third aspects is provided on at least one of a lateral side and a medial side of a forefoot portion of the outsole.

With such a configuration, the flexibility of the shoe, particularly in the lateral side or the medial side of the forefoot portion where flexibility is required, can be improved.

In a fifth aspect, the cut in any one of the first through fourth aspects extends continuously from the ground contact surface to the roll-up portion.

With such a configuration, the flexibility of the shoe can be improved.

In a sixth aspect, the cut in any one of the first through fifth aspects extends to an upper end of the roll-up portion.

With such a configuration, the flexibility of the shoe can be improved.

In a seventh aspect, the cut in any one of the first through sixth aspects extends to around the middle in a width direction of the ground contact surface of the outsole.

With such a configuration, the flexibility of the shoe can be improved.

In an eighth aspect, the cut extending to the ground contact surface in any one of the fifth through seventh aspects is arranged at a position corresponding to an MP (metatarsal phalangeal) joint of a wearer.

With such a configuration, the flexibility of the shoe can be ensured at a position corresponding to an MP joint where higher flexibility is required.

In a ninth aspect, the shoe in any one of the fifth through eighth aspects includes multiple cuts extending to the ground contact surface, and the respective ends of the multiple cuts positioned around the middle in a width direction of the ground contact surface of the outsole are arranged in a curved line.

In a tenth aspect, it is preferable that the curved line in the ninth aspect has a shape that bulges toward the lateral side in a width direction of the outsole.

With such a configuration, the shoe can be provided with flexibility appropriate for tread pressure balance on the sole.

In an eleventh aspect, the flexible region in any one of the first through tenth aspects is provided only on the lateral side of the forefoot portion of the outsole and is not provided on the medial side of the forefoot portion, such that there is a continuous portion that is coextensive with a medial half of a peripheral edge of the outsole body, wherein the continuous portion is continuous from a toe end of the outsole body to a heel end of the outsole body.

With such a configuration, the present invention can be made suitable for a sport in which the wear resistance and the flexibility is required on the lateral side of the forefoot portion, such as skateboarding.

In a twelfth aspect, an intersection part between the ground contact surface and the roll-up portion of the outsole in any one of the first through eleventh aspects makes a substantially right angle.

With such a configuration, the present invention can be made suitable for a sport in which the intersection part between the ground contact surface and the roll-up portion of the outsole is used to control a board, such as skateboarding.

In a thirteenth aspect, on the forefoot portion of the upper in any one of the first through twelfth aspects, an upper protection layer is provided.

With this configuration, the forefoot portion of the upper can be protected.

In a fourteenth aspect, the upper protection layer in the thirteenth aspect is formed of rubber or resin, for example.

In a fifteenth aspect, the upper protection layer in the thirteenth or fourteenth aspect includes a protection reinforcement part, and a flexibility providing part that is thinner than the protection reinforcement part.

With this configuration, flexibility can be also imparted to the upper protection layer.

In a sixteenth aspect, the flexibility providing part in the fifteenth aspect extends along an extended line of the cut.

With this configuration, the cut and the flexibility providing part can be integrally inflected, so that the flexibility of the entire shoe can be improved.

In a seventeenth aspect, the protection reinforcement part in the fifteenth or sixteenth aspect is arranged around the upper end of the roll-up portion.

With this configuration, the upper can be protected around the upper end of the roll-up portion.

In an eighteenth aspect, the shoe in any one of the fifteenth through seventeenth aspects further includes an eyelet part through which a shoelace is inserted, and the protection reinforcement part is arranged near the eyelet part.

With this configuration, the eyelet part and the shoelace inserted therethrough can be protected.

In a nineteenth aspect, the shoe in the eighteenth aspect includes a slit formed to extend in a longitudinal direction of the upper, and the eyelet part is formed on each side of the slit. Also, in a width direction of the shoe, the slit is formed closer to the side opposite to the flexible region side with respect to the middle in a width direction of the shoe. Also, in a width direction of the shoe, the upper protection layer is provided closer to the flexible region side with respect to the slit.

With such a configuration, the upper protection layer can be provided on the flexible region side where protection is further required, so that the upper can be appropriately protected.

In a twentieth aspect, the shoe in any one of the first through nineteenth aspects further includes a shoe tongue having a length such that the shoe tongue can be folded back to reach a position forward of the uppermost eyelet part.

With such a configuration, the shoelace can be protected by the shoe tongue.

In a twenty-first aspect, the outsole in any one of the first through twentieth aspects is formed of rubber.

With such a configuration, grip can be imparted to the out sole.

INDUSTRIAL APPLICABILITY

The present invention is industrially applicable to the field of shoes.

REFERENCE SIGNS LIST

1: shoe, 2: outsole, 4: upper, 6: midsole, 10: outsole body, 12: roll-up portion, 16: flexible region, 18: cut, 20: upper protection layer

What is claimed is:

1. A shoe, comprising:

an outsole including a ground contact surface adapted to be in contact with the ground; and an upper attached directly or indirectly to the outsole opposite to the ground contact surface, wherein the outsole includes:

an outsole body;

a roll-up portion extending from an edge of the outsole body toward the upper;

a flexible region provided only on a lateral side of a forefoot portion of the outsole;

at least one cut extending from the outsole body to the roll-up portion and formed in the flexible region; and a continuous portion that is coextensive with a medial half of a peripheral edge of the outsole body, wherein the continuous portion is continuous from a toe end of the outsole body to a heel end of the outsole body, wherein, on a forefoot portion of the upper, an upper protection layer is provided, wherein the upper protection layer includes a protection reinforcement part, and a flexibility providing part that is thinner than the protection reinforcement part, wherein the shoe comprises an eyelet part through which a shoelace is inserted, wherein the protection reinforcement part is arranged near the eyelet part, wherein the shoe comprises a slit formed on the upper to extend in a longitudinal direction of the upper, the eyelet part being formed on each of two opposing sides of the slit in a width direction of the slit, wherein, in a width direction of the shoe, the slit is formed closer to a side opposite to the flexible region with respect to a middle of the upper in the width direction of the shoe, and wherein, in the width direction of the shoe, the upper protection layer is provided closer to the flexible region than the slit, and the slit is further away from the flexible region than the upper protection layer.

2. The shoe according to claim 1, wherein the at least one cut has a predetermined width in a longitudinal direction of the outsole.

3. The shoe according to claim 1, comprising a midsole provided between the outsole and the upper, wherein the roll-up portion extends to a position higher than an upper surface of the midsole.

4. The shoe according to claim 1, wherein the at least one cut extends continuously from the ground contact surface to the roll-up portion.

5. The shoe according to claim 4, wherein the at least one cut extending to the ground contact surface is arranged at a position adapted to correspond to a metatarsal phalangeal joint of a wearer.

6. The shoe according to claim 4, wherein the at least one cut comprises a plurality of cuts extending to the ground contact surface, wherein ends of the plurality of cuts positioned around a middle of the ground contact surface in a width direction of the ground contact surface of the outsole are arranged in a curved line.

7. The shoe according to claim 6, wherein the curved line has a shape that bulges toward a lateral side of the ground contact surface in a width direction of the outsole.

8. The shoe according to claim 1, wherein the at least one cut extends to an upper end of the roll-up portion.

9. The shoe according to claim 1, wherein the at least one cut extends to around a middle of the ground contact surface in a width direction of the ground contact surface of the outsole.

10. The shoe according to claim 1, wherein an intersection part between the ground contact surface and the roll-up portion of the outsole makes a substantially right angle.

11. The shoe according to claim 1, wherein the upper protection layer is formed of rubber or resin.

12. The shoe according to claim 1, wherein the flexibility providing part extends along an extended line of the at least one cut.

13. The shoe according to claim 1, wherein the protection reinforcement part is arranged around an upper end of the roll-up portion.

14. The shoe according to claim 1, comprising a shoe tongue having a length such that the shoe tongue can be folded back to reach a position forward of an uppermost eyelet part.

* * * * *